US006105542A

United States Patent [19]

Efford

[11] Patent Number: 6,105,542

[45] Date of Patent: Aug. 22, 2000

[54] MODULAR ENGINE

[76] Inventor: Clive William Efford, 2 White Cottages, Mumby's Drove, Threeholes, Wisbech, Cambs. PE14 9JT, United Kingdom

[21] Appl. No.: 09/125,923

[22] PCT Filed: Mar. 3, 1997

[86] PCT No.: PCT/GB97/00575

§ 371 Date: Aug. 25, 1998

§ 102(e) Date: Aug. 25, 1998

[87] PCT Pub. No.: WO97/33072

PCT Pub. Date: Sep. 12, 1997

[30] Foreign Application Priority Data

Mar. 6, 1996 [GB] United Kingdom ..... 9604769

[51] Int. Cl.[7] ..... F02B 75/18

[52] U.S. Cl. ..... 123/52.4; 123/188.4; 123/197.5; 123/DIG. 8

[58] Field of Search ..... 123/52.4, 53.2, 123/197.5, DIG. 8, DIG. 1, DIG. 6, 188.4; 477/6

[56] References Cited

U.S. PATENT DOCUMENTS

| | | | |
|---|---|---|---|
| 1,492,587 | 5/1924 | Toth | 123/188.4 |
| 1,537,248 | 5/1925 | Maloney | 123/188.4 |
| 1,574,686 | 2/1926 | Petticore | 123/188.4 |
| 1,781,176 | 11/1930 | Grube | 123/188.4 |
| 3,332,404 | 7/1967 | Lovercheck | 123/55.2 |
| 3,390,670 | 7/1968 | Brice | 123/197.1 |
| 4,337,623 | 7/1982 | Kronogard | 60/716 |
| 4,638,637 | 1/1987 | Kronogard et al. | 60/718 |
| 4,662,490 | 5/1987 | Yamakawa | 477/6 |
| 4,714,060 | 12/1987 | Kesteloot | 123/195 R |
| 4,765,287 | 8/1988 | Taylor et al. | 123/81 D |
| 5,647,309 | 7/1997 | Avery | 123/58.8 |
| 5,694,890 | 12/1997 | Yazdi | 123/58.9 |

FOREIGN PATENT DOCUMENTS

| | | | |
|---|---|---|---|
| 572174 | 6/1924 | France | 123/188.4 |
| 2044943 | 3/1972 | Germany . | |
| 8501548 | 4/1985 | WIPO . | |

OTHER PUBLICATIONS

Wassenaar, *Machine Design,* vol. 61, No. 16, "Novel Diesel Engines to be Built in Modules," p. 38 (Aug. 10, 1989).

*Primary Examiner*—Noah P. Kamen
*Attorney, Agent, or Firm*—Edwin D. Schindler

[57] ABSTRACT

A modular engine has a plurality of engine sections, with each of the engine sections having a power module, which power modules are bolted to one another in a selected positional relationship. A link-up device is selectively able to couple any number of the engine sections to one or more output shafts. An engine management system controls the link-up device so that, in use, and according to power requirements, any one or more of the engine sections is brought into operation, or is withdrawn from operation, such that the single overall engine is able to utilize power from any number of the power modules of the engine sections (e.g., three or more) for driving the output shaft(s).

17 Claims, 6 Drawing Sheets

48
36
46
34
50
52
38
40
42
56

MODULAR ENGINE

BACKGROUND OF THE INVENTION

1. Technical Field of the Invention

This invention relates to a modular engine.

2. Description of the Prior Art

Various proposals have been made in the prior art for equipping a vehicle, whether land borne or water borne, with two or more engines which can be selectively used.

SUMMARY OF THE INVENTION

The present invention has for one object to provide a single power unit, for static or mobile use, having a plurality of interconnectable power modules.

According to one aspect of the invention, there is provided an engine comprising two or more power modules, and means for bolting the modules together in a selected positional relationship, said means including an enclosed link-up device for coupling any one or both power modules to a common output shaft.

Most commonly, each power module will comprise at least one cylinder and a crankshaft, the link-up device coupling any one, both or all crankshafts to a common output shaft, whereby to provide a modular internal combustion engine.

However, the link-up device could alternatively be used to link up two or more gas turbines or electric motors, for example.

According to another aspect of the invention, there is provided a link-up unit, e.g. the aforesaid enclosed link-up device, in the form of a gear casing incorporating gears for selectively interconnecting a plurality of power outputs, e.g. a plurality of crankshafts, with the output shaft. Alternatively, a casing can be provided incorporating hydraulic pumps which are driven by the respective crankshafts and are linked by a control valve. When enclosed gearing is employed, clutches may be incorporated to enable controlled selection of and number of power units in use. A suitable clutch may be a torque converter, fluid flywheel, centrifugal clutch, hydraulic clutch or spring and pressure plate.

In the case of an internal combustion engine, the cylinder block modules are preferably cast or moulded and are bolted to a crankcase, linked by cooling tubes. A cylinder block module and crankcase may alternatively be cast or moulded as an integral unit. Wet or dry liners may be fitted. While the cylinder block modules may have open tops for fitting of cylinder block heads and associated conventional valves, preferably the cylinder block modules are closed at the top, but bored with apertures for the fitting of valve housings, as later described.

The crankcase is moulded or cast, preferably of open web-type construction, with full main housings drilled for oil passages and returns. Universal drillings are preferably provided for bolting cylinder block modules together. Side plates and sumps are preferably incorporated and, desirably, the crankshaft swing can extend partly into a casing cutaway whilst clearing the parting plate.

The side plate, in particular, can be made in different sizes and shapes to suit the number of cylinder block modules and the relative positionings thereof required for different engines. Thus, any number of engines required for different vehicle models and uses therof can be produced, all based on the same cylinder block module.

As previously mentioned, instead of the cylinder block module being open at the top to receive a conventional cylinder head and conventional camshaft operated valves, most preferably a closed top cylinder block module is employed.

Thus, according to another aspect of the invention, there is provided an internal combustion engine comprising a cylinder block incorporating at least one cylinder, wherein the cylinder head is dispensed with, and instead at least one machined valve housing is bolted to the cylinder block, the or each valve housing incorporating one or more slide valves which control the intake of fuel or fuel/air mixture through apertures bored in the wall of the cylinder block.

A preferred valve comprises a slide valve housing, valve slide, driving cam for the valve slide and biassing spring or hydraulic damper for the valve slide. Servicing is thus made possible in like manner to that of fuel injectors. The preferred valve system is especially suitable for gas fueled vehicles.

A cylinder block module can be fitted with two, three or four such valves per cylinder, single or twin cam.

BRIEF DESCRIPTION OF THE DRAWING FIGURES

The invention is further described with reference to the accompanying diagrammatic drawings, in which.

Figure 4:
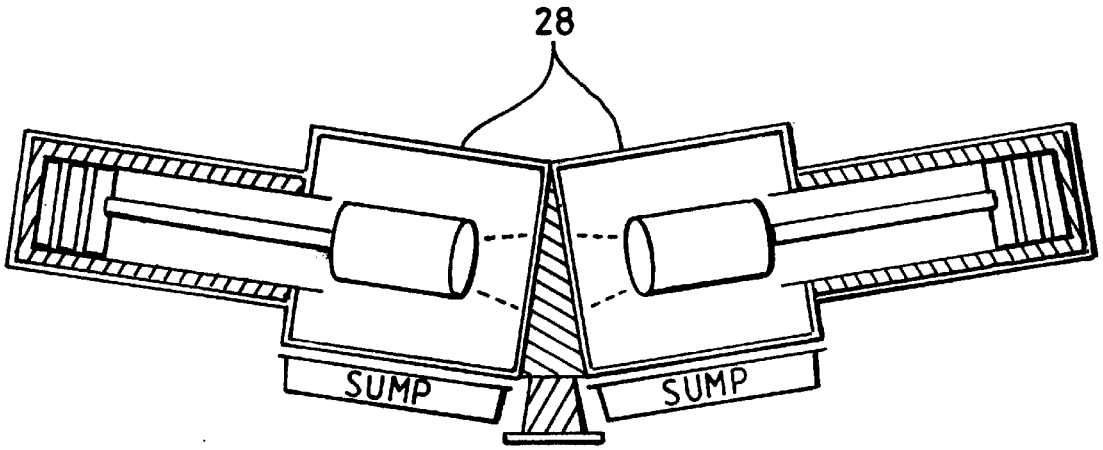
FIG. 4 shows an engine comprising two cylinder modules.
Figure 4:
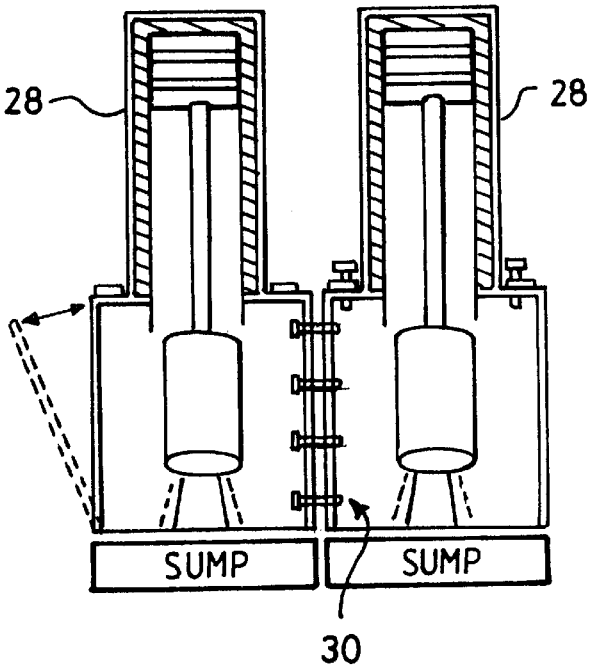
Figure 5:
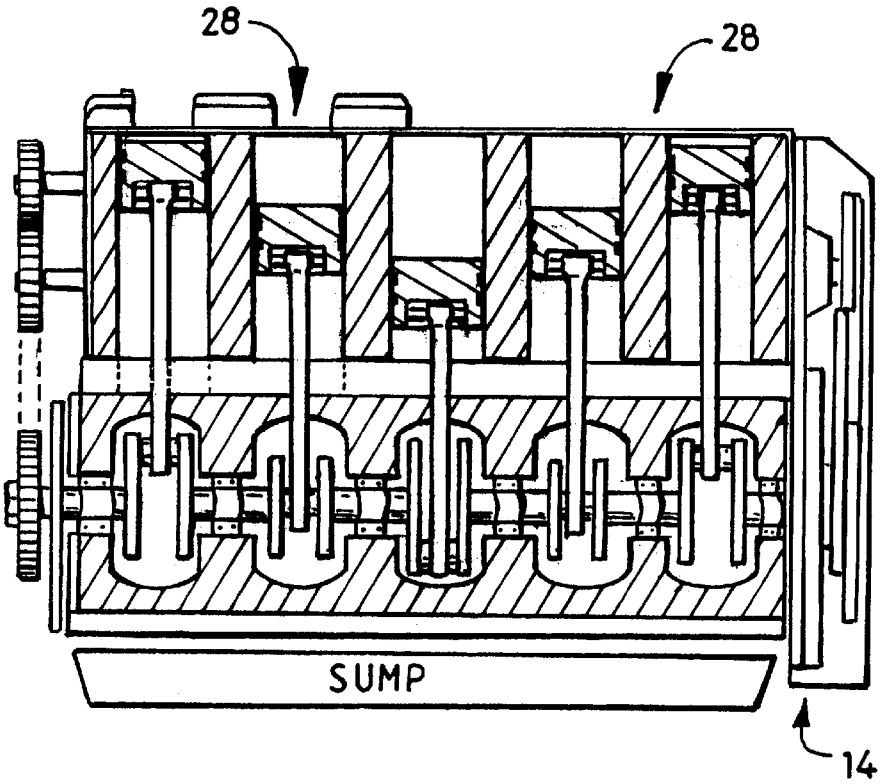
Figure 6:
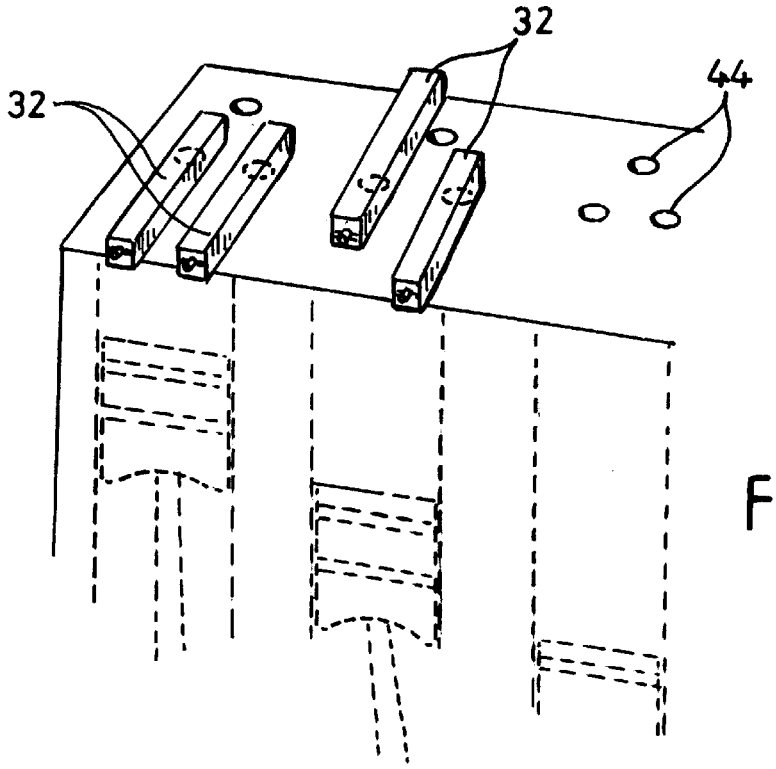
Figures 7, 7B, 7C, 7D:
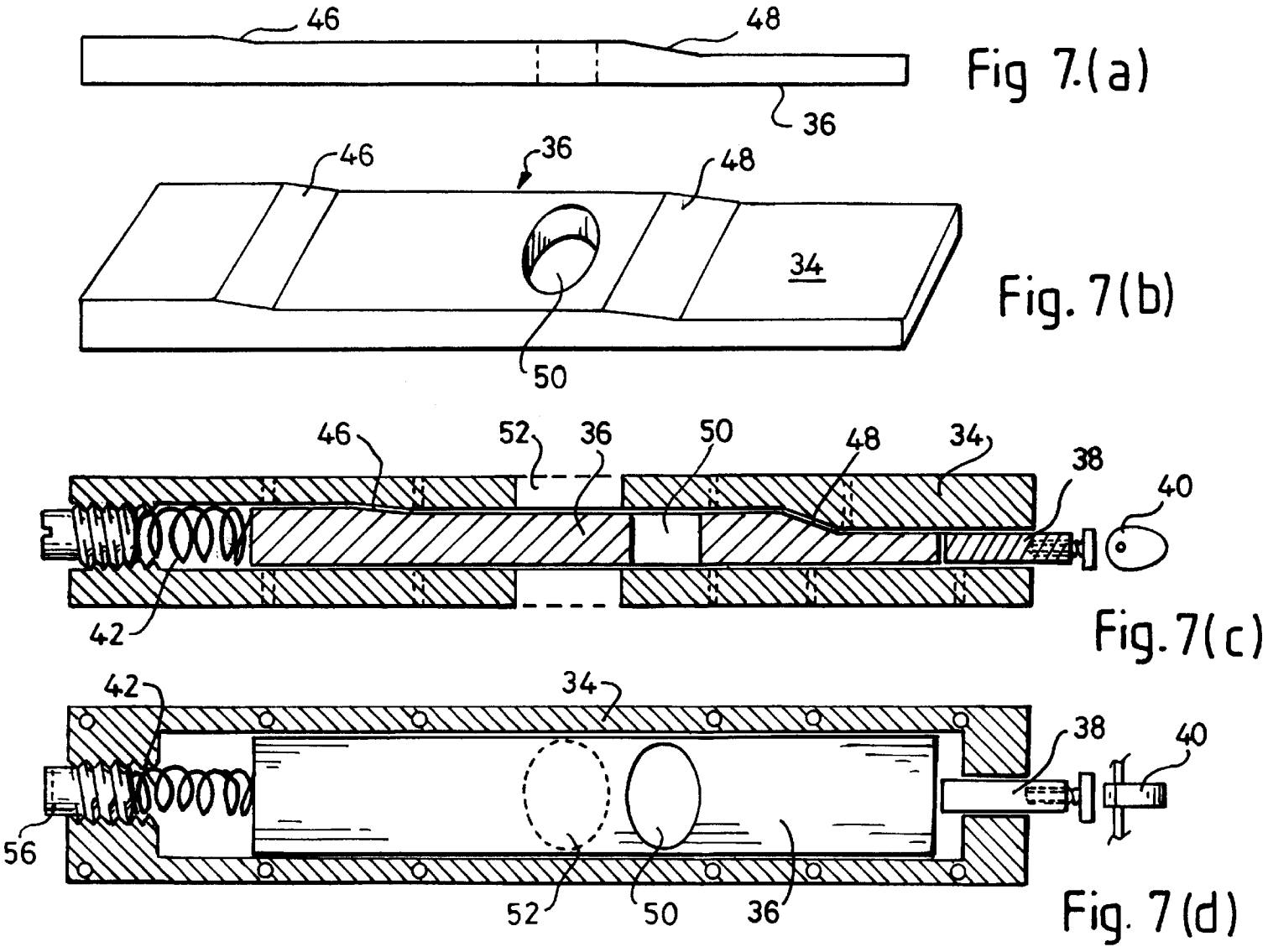

FIG. 4*a* shows a modification of the engine of FIG. 4;

FIG. 5 is a side view of the engine of FIG. 4;

FIG. 6 shows part of an engine having a preferred valve control system; and

FIGS. 7*a* to 7*d* show details of a preferred control valve.

DETAILED DESCRIPTION OF THE DRAWINGS AND PREFERRED EMBODIMENTS

Figure 1:
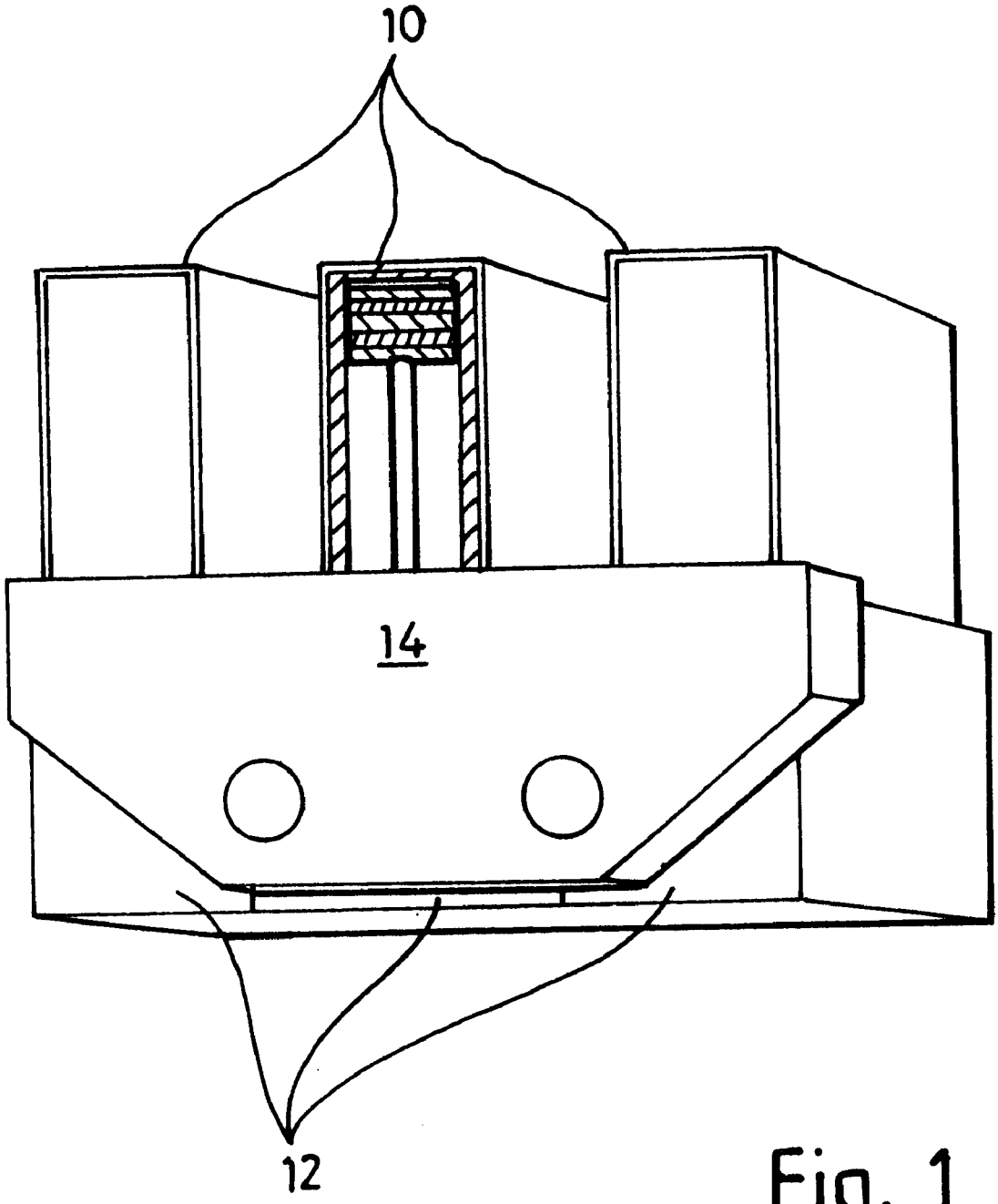
FIG. 1 is a perspective view of an engine comprising cylinder block module, crankcase and link-up unit.

Referring to FIG. 1, there are shown three cylinder block modules 10, each comprising one or more cylinders, bolted together via a crankcase unit 12, one for each cylinder module, and a link-up unit 14.

Figure 2:
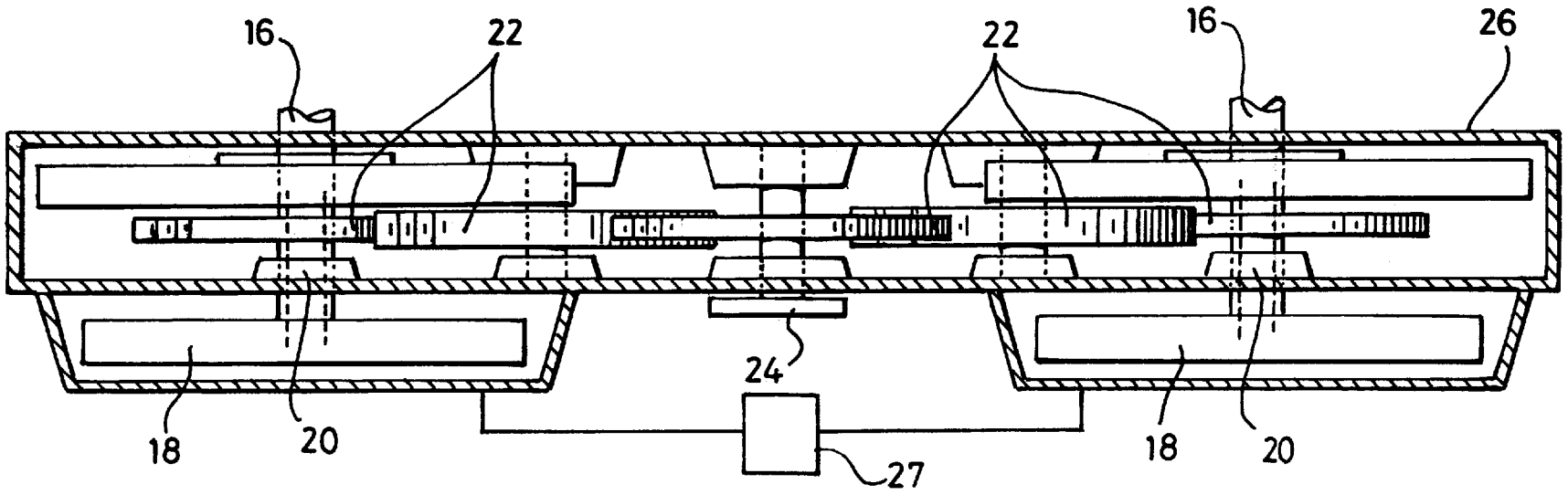
FIG. 2 is a plan view of the interior of a link-up unit, for an engine having two cylinder block modules.
Figure 3:
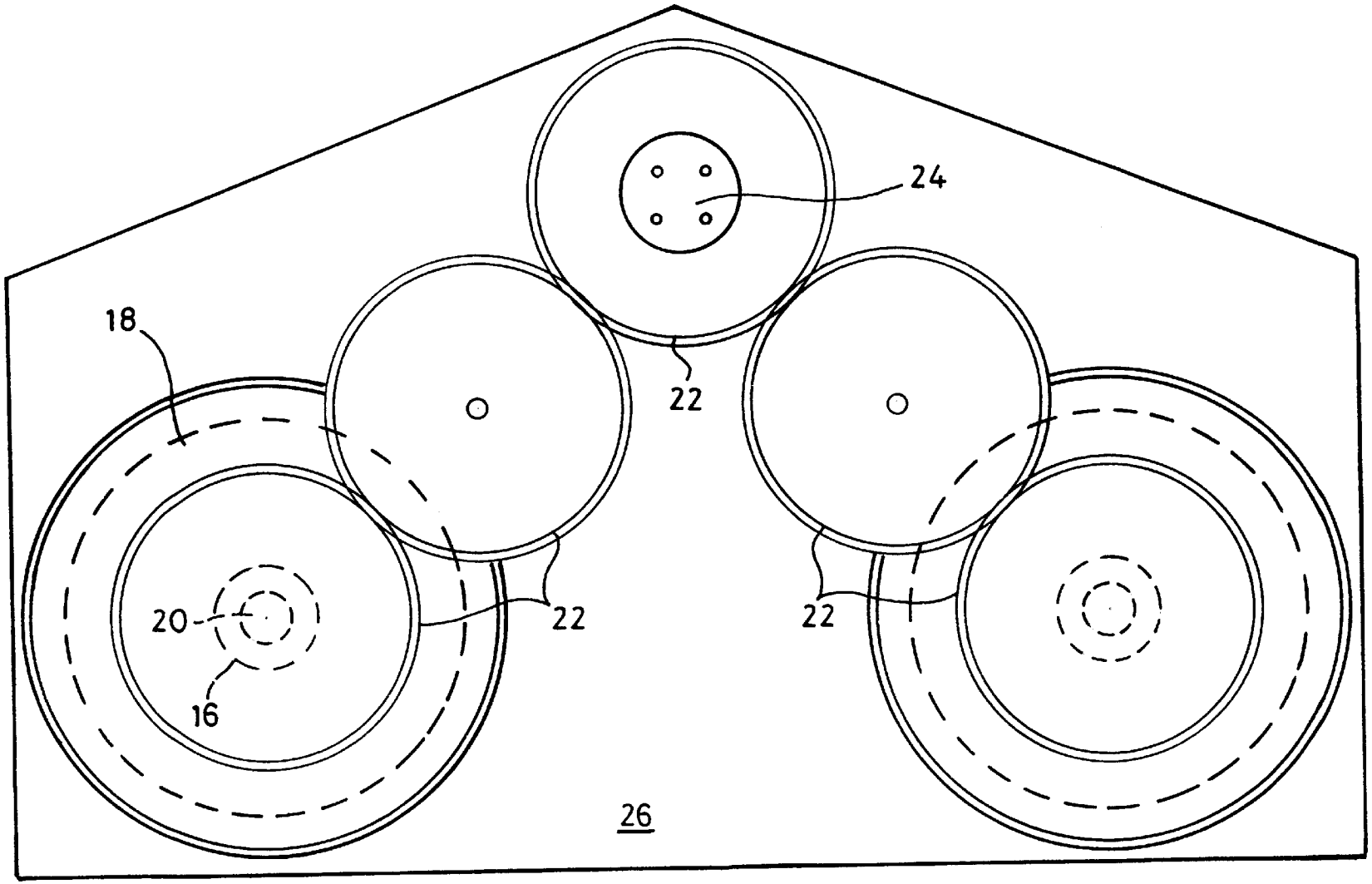
FIG. 3 is a view of the interior of the link-up unit.

FIGS. 2 and 3 show the interior of a link-up unit for an engine having two cylinder block modules. Such a link-up unit can readily be modified to suit an engine having three cylinder block modules, as in FIG. 1, or four or more cylinder block modules.

The link-up unit of FIGS. 2 and 3 shows the crankshafts 16 of the two cylinder block modules coupled via clutches 18 and coaxial inner and outer shafts 20 to gear trains 22 which couple to an output drive shaft 24. Reference 26 denotes the back plate of the link-up unit.

The clutches are automatically controlled by an engine management system 27 so that either one or both cylinder block modules are coupled to the output shaft, depending on the variable power requirements of the engine when in use.

FIG. 4 shows an engine having two cylinder block modules 28 bolted together at 30. The cylinder block modules could be integrally formed each with its crankcase. FIG. 4*a* shows the versatility of the arrangement, in that according to requirements the cylinder block modules 28 can be interconnected in any desired positional relationship, in association with appropriate re-arrangement of the link-up unit.

FIG. 5 shows the engine of FIG. 4 in side view, with the link-up unit 14 on the right.

FIG. 6 shows part of a cylinder block module, and more especially a preferred valve control system therefor. Instead of being open topped to receive a cylinder head and conventional camshaft controlled valves, the top of the module is closed, and fitted with slide valves 32 controlling the injection of fuel into the engine. The arrangement is especially suitable for a gas fuelled engine.

FIGS. 7*a* to 7*d* show detail of one of the slide valves. This comprises a valve housing 34 in which is incorporated a tapered valve slide 36 controlled by a cam follower 38 driven by cam 40 on the camshaft and acting against a spring or hydraulic damper 42. The valve slide 36 opens and closes parts 44 bored in the top wall of the cylinder block module (see also FIG. 6).

More generally, the basic cylindrical block module can be built with two, three or four valves per cylinder, fitted on top with single or twin cams, or side fitted as a crossflow with twin cams. However, conventional valves driven by a conventional camshaft drive could be employed instead. In the arrangement shown in FIG. 7, the valves are provided on a machined face of the cylinder block to which the machined valve housing 34 is bolted. The valve is hardened and has two tapers 46, 48 which holds the valve tightly closed with the spring 42 or hydraulic pressure holding the slide 36 to the tapers. The valve slide 36 has the cam follower 38 in front for adjustment and for operating the valve when pushed by the cam 40 to open the port by aligning hole 50 in the valve slide with apertures 52 in the valve housing 34. On release, the valve slide 36 is pushed back onto the tapers holding it closed. Servicing can be carried out by either unbolting the entire valve unit or removing the valve plate, in situ, by removing spring cap 56 and replacing any required parts.

Each crankshaft is fitted with a clutch and sliding gear, but the latter is optional, depending on type of clutch used. A torque converter, fluid flywheel, or any other type of clutch can be employed. The gear train can be variable to suit requirements, and the output shaft be fitted in a variety of positions, e.g. high to lower the centre of gravity, and low in marine applications to permit shafts to be fitted in the keel. Moreover, various numbers of output shafts can be used, depending on the number of crankshafts used.

Most importantly, computer control technology, incorporated in the engine management system, will enable multiple crankshafts to run at an identical speed, and to be stopped or brought back into synchronism as and when required.

Some of the many advantages are as follows:

The optional layout of the engine enables designers to lower the centre of gravity, leading to greater stability and increased safety; also with hydraulic power the engine could be fitted in any position in order to improve space or accessibility, as well as eliminating the stress of torque.

The casting may be manufactured of various materials, including some plastics to save weight and costs. As the crankshafts will be housed as single units capable of being bolted together, many savings can be made in production and design as well as in speed and ease of unit or part-unit replacement; also spares stockholding economies.

By making provision for various mounting positions only the side plates and sumps need be made and fitted to allow the units to be adopted in a large number of applications and in different combinations.

The engine is capable of running on any fuel type for which the engine is built, liquid or gas, and by sump or external oil reservoir and pump, and the preferred valve system enables considerable space saving in the overall height of the unit, giving many design advantages. Moreover, as no head is used with this valve system, there is no risk of headgasket problems, and the valves can be changed simply.

Whereas the drawings in general illustrate internal combustion engines acting on a four-stroke cycle, the invention is also applicable to engines operating on a two-stroke cycle. The illustrated engines also incorporate camshafts. However, the invention is also applicable to camless engines incorporating unit valve activators, and to engines wherein the cams are operated by an electronic unit instead of a cam shaft.

Finally, the link up concept is also suitable for use in connecting gas turbine modules or electric power supplies, i.e. electric motors.

What is claimed is:

1. A single engine having at least one output shaft, comprising:

a plurality of engine sections, each of said engine sections comprising a power module;

means for bolting said plurality of engine sections together in a selected positional relationship;

means including an enclosed link-up device for selectively coupling any number of said engine sections to the, at least one, output shaft; and, an engine management system having means for controlling the link-up device so that, in use, and according to power requirements, any one or more of said plurality of engine sections is brought into operation, or is withdrawn from operation, wherein the single engine is capable of utilizing power from any number of said power modules of said engine sections for driving the, at least one, output shaft.

2. An engine according to claim 1, wherein each power module comprises at least one cylinder and one crankshaft, the link-up device selectively coupling any one, both or all crankshafts to the common output shaft or shafts, whereby to provide an internal combustion engine.

3. An engine according to claim 2, wherein the link-up device comprises a gear casing incorporating gears for selectively interconnecting a plurality of crankshafts with the common output shaft or shafts.

4. An engine according to claim 2, wherein a cylinder block module is closed at the top and bored with apertures for a fitting of slide valve housings.

5. An engine according to claim 2, wherein a cylinder block module is bolted to, or integrally formed with, a crankcase.

6. An engine according to claim 5, wherein the crankcase is designed and built in size and shape to suit the number of cylinder block modules and the relative positonings of the latter required for different engines.

7. An engine according to claim 2, comprising a cylinder block incorporating at least one cylinder and having at least one machined valve housing bolted to said cylinder block, each of said valve housings incorporates at least one slide valve which controls an intake of air for a direct injection of fuel through apertures bored in a wall of said cylinder block.

8. An engine according to claim 7, wherein each valve comprises a slide valve housing, a valve slide, a driving cam for the valve slide and a biassing spring or hydraulic damper for the valve slide.

9. An engine according to claim 7, adapted to be fueled by gas.

10. An engine according to claim 2, comprising a cylinder block incorporating at least one cylinder and having at least one machined valve housing bolted to said cylinder block, each of said valve housings incorporates at least one slide valve which controls an intake of air for a direct injection of a fuel-and-air mixture through apertures bored in a wall of said cylinder block.

11. An engine according to claim 10, wherein each valve comprises a slide valve housing, a valve slide, a driving cam for the valve slide and a biassing spring or hydraulic damper for the valve slide.

12. An engine according to claim 10, adapted to be fueled by gas.

13. A single engine having at least one output shaft, comprising:

at least three engine sections, each of said engine sections comprising a power module;

means for bolting said engine sections together in a selected positional relationship;

means including an enclosed link-up device for selectively coupling any number of said engine sections to the, at least one, output shaft; and, an engine management system having means for controlling the link-up device so that, in use, and according to power requirements, any one or more of said at least three engine sections is brought into operation, or is withdrawn from operation, wherein the single engine is capable of utilizing power from any number of said power modules of said engine sections for driving the, at least one, output shaft.

14. An engine according to claim 13, wherein each said power module comprises at least one cylinder and one crank-shaft, the link-up device selectively coupling any number of crankshafts to the common output shaft or shafts, for providing an internal combustion engine.

15. An engine according to claim 14, wherein the link-up device comprises a gear casing incorporating gears for selectively interconnecting a plurality of crankshafts with the common output shaft or shafts.

16. An engine according to claim 15, wherein a cylinder block module for each of said cylinders is bolted to, or integrally formed with, a crankcase.

17. An engine according to claim 14, wherein each of said cylinders has a cylinder block module which is closed at the top and bored with apertures for fitting of slide valve housings.

* * * * *